US005842886A

United States Patent [19]

Illg et al.

[11] Patent Number: 5,842,886

[45] Date of Patent: Dec. 1, 1998

[54] PLUG RECEIVING CONNECTOR

[75] Inventors: Manfred Illg, Weinstadt; Andreas Schremmer, Schorndorf; Tobias Schimmele, Lauffen, all of Germany

[73] Assignee: ITT Manufacturing Enterprises, Inc., Wilmington, Del.

[21] Appl. No.: 864,699

[22] Filed: May 28, 1997

[30] Foreign Application Priority Data

May 30, 1996 [DE] Germany ..... 196 21 614.1

[51] Int. Cl.[6] ..... H01R 13/648

[52] U.S. Cl. ..... 439/607; 439/83

[58] Field of Search ..... 439/607, 609, 439/610, 83, 76.1

[56] References Cited

U.S. PATENT DOCUMENTS

| | | | |
|---|---|---|---|
| 4,908,335 | 3/1990 | Cosmos et al. | 439/79 |
| 5,017,156 | 5/1991 | Sugiyama | 439/607 |
| 5,073,130 | 12/1991 | Nakamura | 439/607 |
| 5,104,326 | 4/1992 | Smith et al. | 439/95 |
| 5,228,873 | 7/1993 | Hirai | 439/607 |
| 5,273,460 | 12/1993 | Arai | 439/609 |
| 5,288,247 | 2/1994 | Kaufman | 439/607 |
| 5,304,069 | 4/1994 | Brunker et al. | 439/108 |
| 5,344,327 | 9/1994 | Brunker et al. | 439/108 |
| 5,387,114 | 2/1995 | Brunker et al. | 439/108 |
| 5,470,259 | 11/1995 | Kaufman et al. | 439/607 |
| 5,478,260 | 12/1995 | Kaufman et al. | 439/609 |
| 5,486,117 | 1/1996 | Chang | 439/357 |
| 5,660,558 | 8/1997 | Osanai et al. | 439/607 X |
| 5,685,739 | 11/1997 | Davis et al. | 439/607 |
| 5,718,605 | 2/1998 | Morikawa et al. | 439/607 |

FOREIGN PATENT DOCUMENTS 0 512 438 A2 11/1992 European Pat. Off. .

*Primary Examiner*—Khiem Nguyen
*Attorney, Agent, or Firm*—Thomas L. Peterson

[57] ABSTRACT

A plug-receiving connector is provided, which includes a molded plastic housing (12) for mounting on a circuit board, which minimizes stress on the plastic housing in mounting it and in latching to a mating plug. A sheet metal bracket (14) has a top plate part (46) that lies over the top wall (28) of the plastic housing and has a pair of depending sheet metal parts (47, 48, 58, 59) at each of the opposite sides of the top plate part. One of the depending sheet metal parts of each pair is a holding tab (58, 59) that extends through a slit (31, 32) in the plastic housing top wall, through a plug-receiving cavity (16) formed by the housing, and into a slit (33, 34) in a plastic housing bottom wall (29). Each of the second depending sheet metal parts comprises a sheet metal side (47, 48) that lies closely outside a corresponding plastic housing side wall (26, 27), so each plastic housing side wall is sandwiched between a sheet metal holding tab and a sheet metal side. Each sheet metal side has a lower end holding a horizontally-extending mount tab (51, 52) that is mounted on the circuit board as by soldering it thereto.

11 Claims, 6 Drawing Sheets

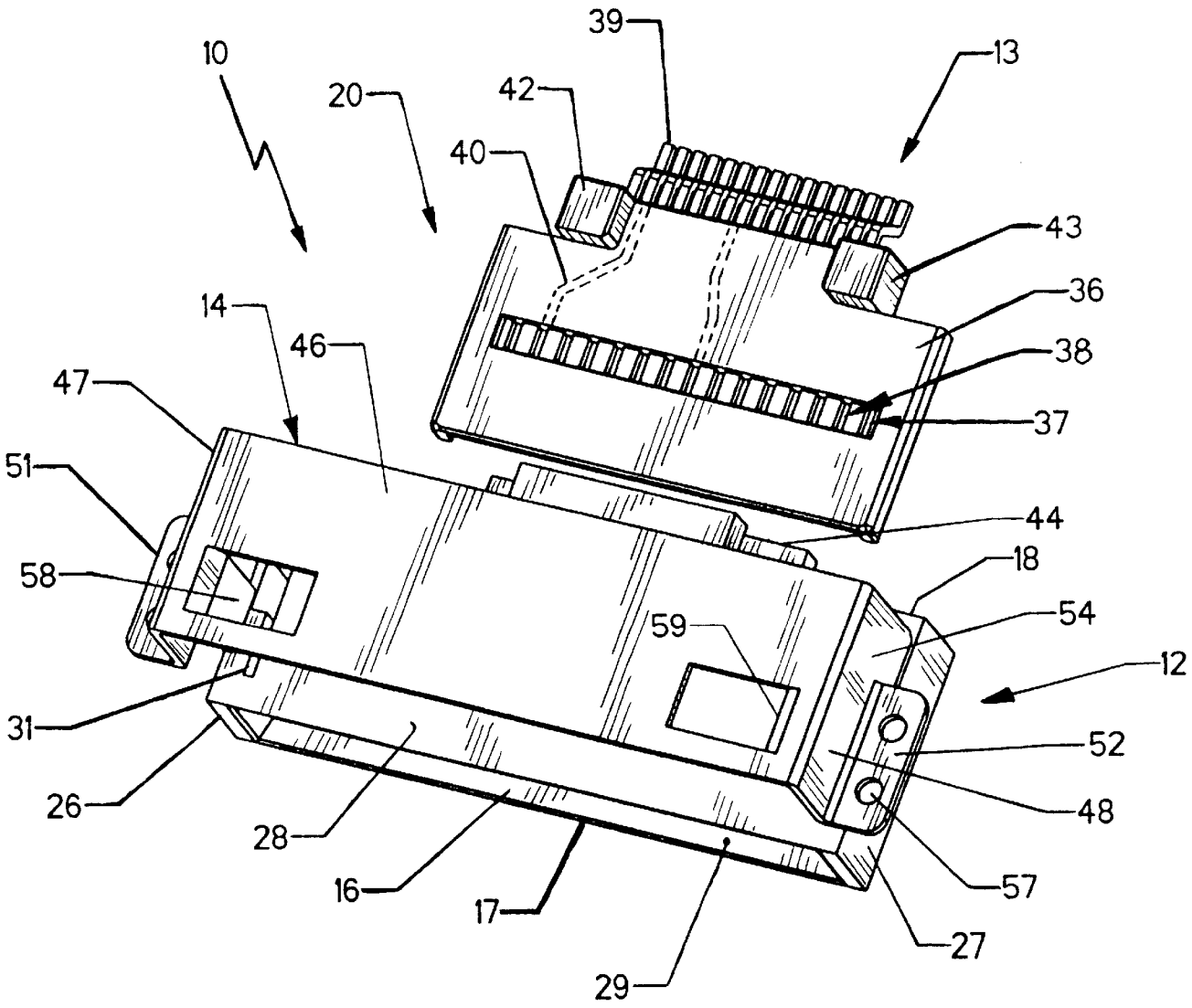
Fig. 2
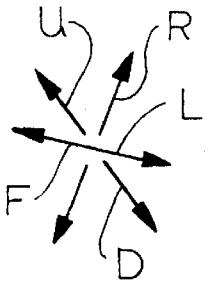

PLUG RECEIVING CONNECTOR

BACKGROUND OF THE INVENTION

Small plug-receiving connectors that can be fastened to circuit boards, are commonly used in applications such as in mobile telephones. Although progressively smaller connectors are required, they must still be able to withstand forces applied during reception and removal of a plug as well as forces applied through a cable and the plug to the connector. This must be accomplished with a minimum number of thin parts to reduce the size and cost of the connectors.

SUMMARY OF THE INVENTION

One object of the present invention is to create a miniature plug connector with a molded plastic plug-receiving housing having thin walls, which minimizes stress and wear on the plastic housing using a minimum number of low cost components.

In accordance with one embodiment of the present invention, a plug-receiving connector and the combination of that connector with a circuit board is provided, wherein the connector includes a molded plastic housing forming a cavity for accurate plug reception and with a minimum of other components for minimizing stresses and wear on the plastic housing. A sheet metal bracket has a top plate part that lies over the plastic housing, and has a pair of sheet metal holding tabs that depend from laterally opposite sides of the top plate part. Each holding tab projects down through a slit in a plastic housing top wall, through the plug-receiving cavity in the plastic housing, and into a slit in a plastic housing bottom wall. The sheet metal holding tab helps hold the bracket to the housing, and each tab can serve as a strike which can hold a latching mechanism of a plug inserted into a cavity of the plastic housing.

The sheet metal bracket includes a pair of sheet metal bracket sides that depend from laterally opposite sides of the top plate part and that extend closely outside opposite plastic housing side walls. Each plastic side wall is preferably trapped between a holding tab and a sheet metal side. Each sheet metal side has a lower end that holds a mount tab that can be fastened to the circuit board, as by soldering it thereto. As a result, forces tending to move the plastic housing relative to the circuit board are born primarily by the sheet metal bracket, through its mount tabs that are held to the circuit board and through its sheet metal sides, holding tabs, and top plate part. The sheet metal bracket also serves as an EMI (electromagnetic interference) shield. All of this can be achieved with a single piece sheet metal bracket that can be constructed and mounted at low cost and which enables a thin-walled plastic housing to be used.

The novel features of the invention are set forth with particularity in the appended claims. The invention will be best understood from the following description when read in conjunction with the accompanying drawings.

BRIEF DESCRIPTION OF THE DRAWINGS

FIG. 2 is an exploded top isometric view of the plug-receiving connector of FIG. 1.

DESCRIPTION OF THE PREFERRED EMBODIMENTS

Figure 1:
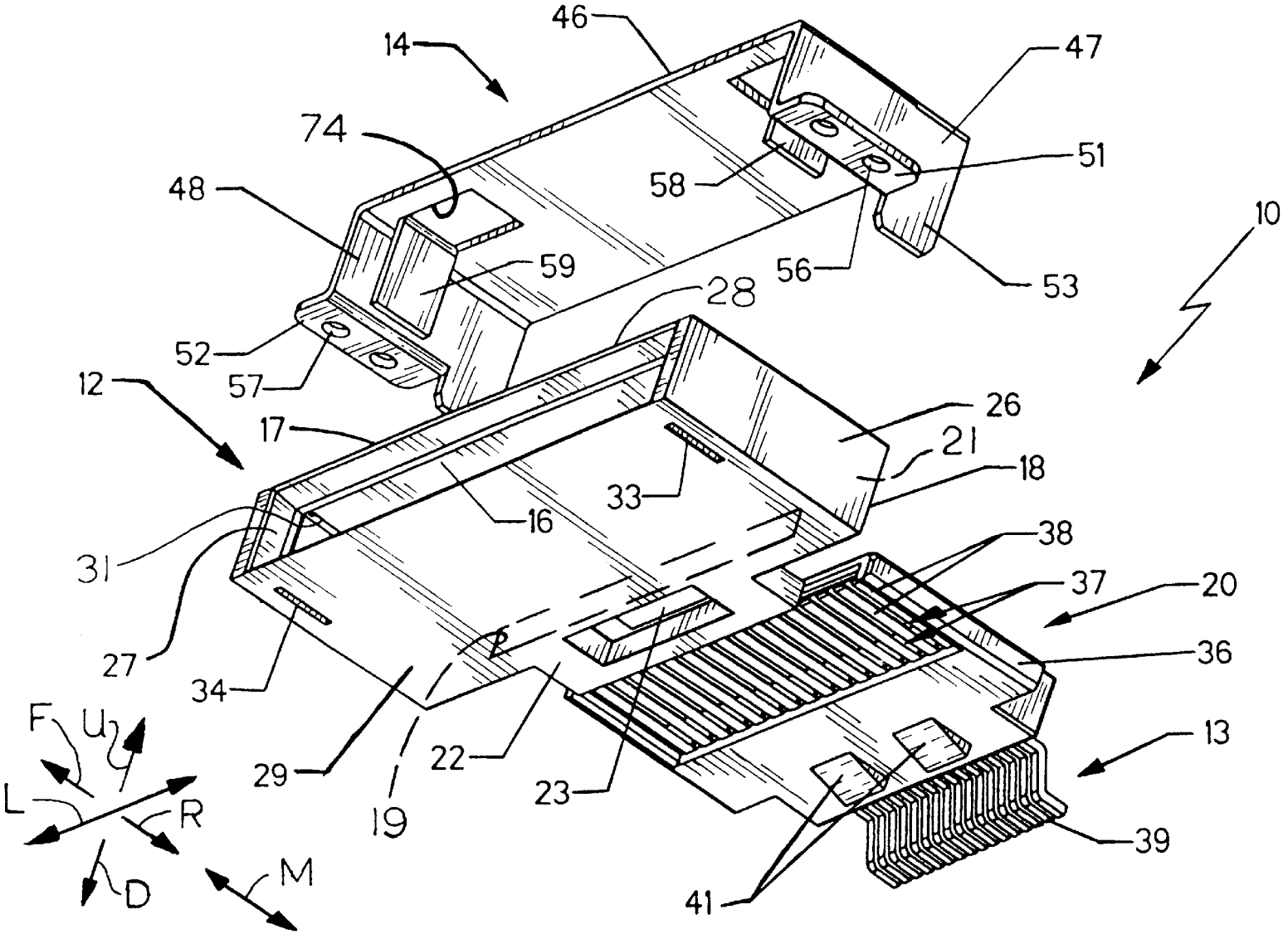
FIG. 1 is an exploded bottom isometric view of a plug-receiving connector of the present invention.
Figure 3:
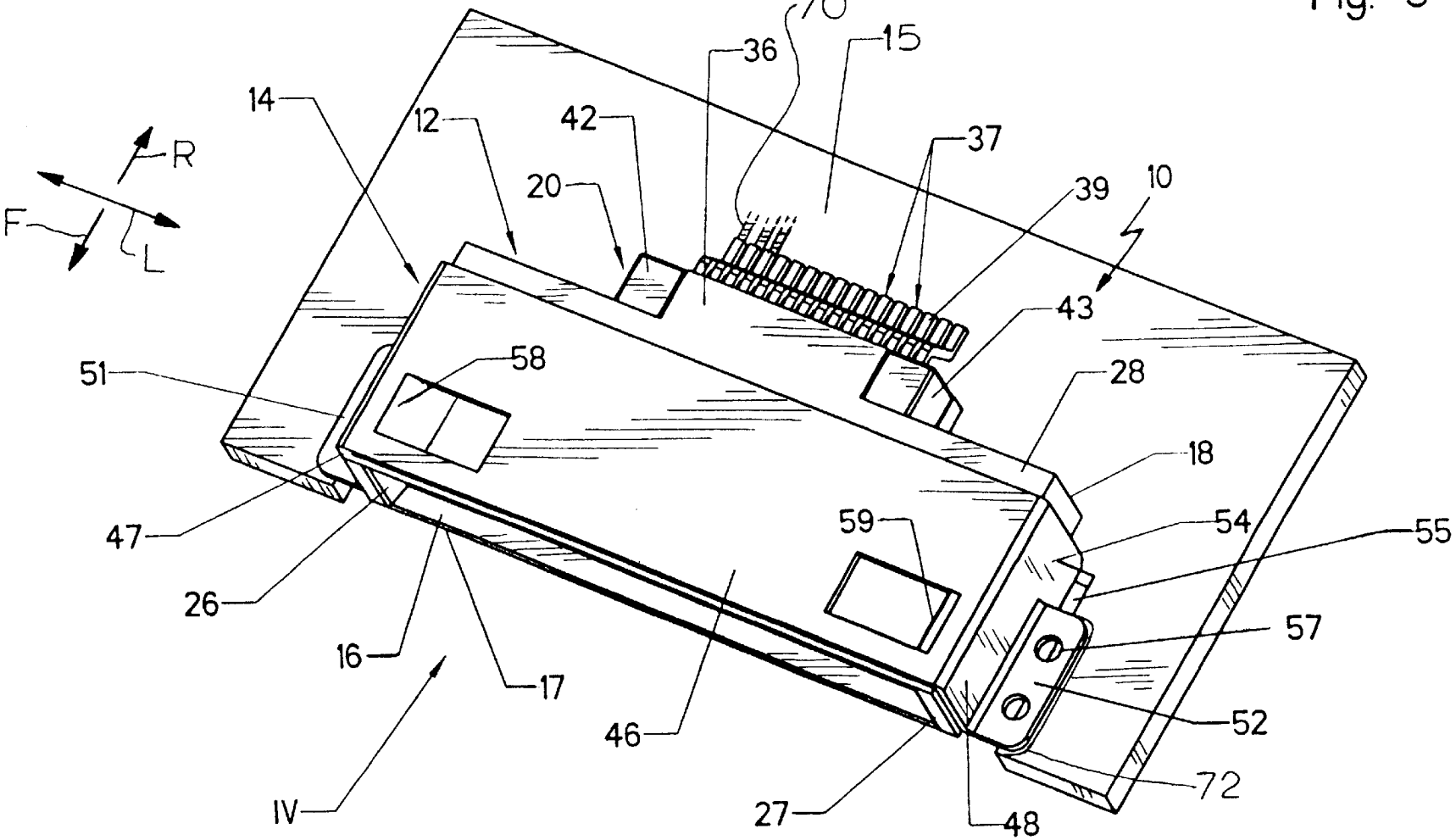
FIG. 3 is a top isometric view of the plug-receiving connector of FIGS. 1 and 2, shown assembled and mounted on a circuit board.
Figure 4:
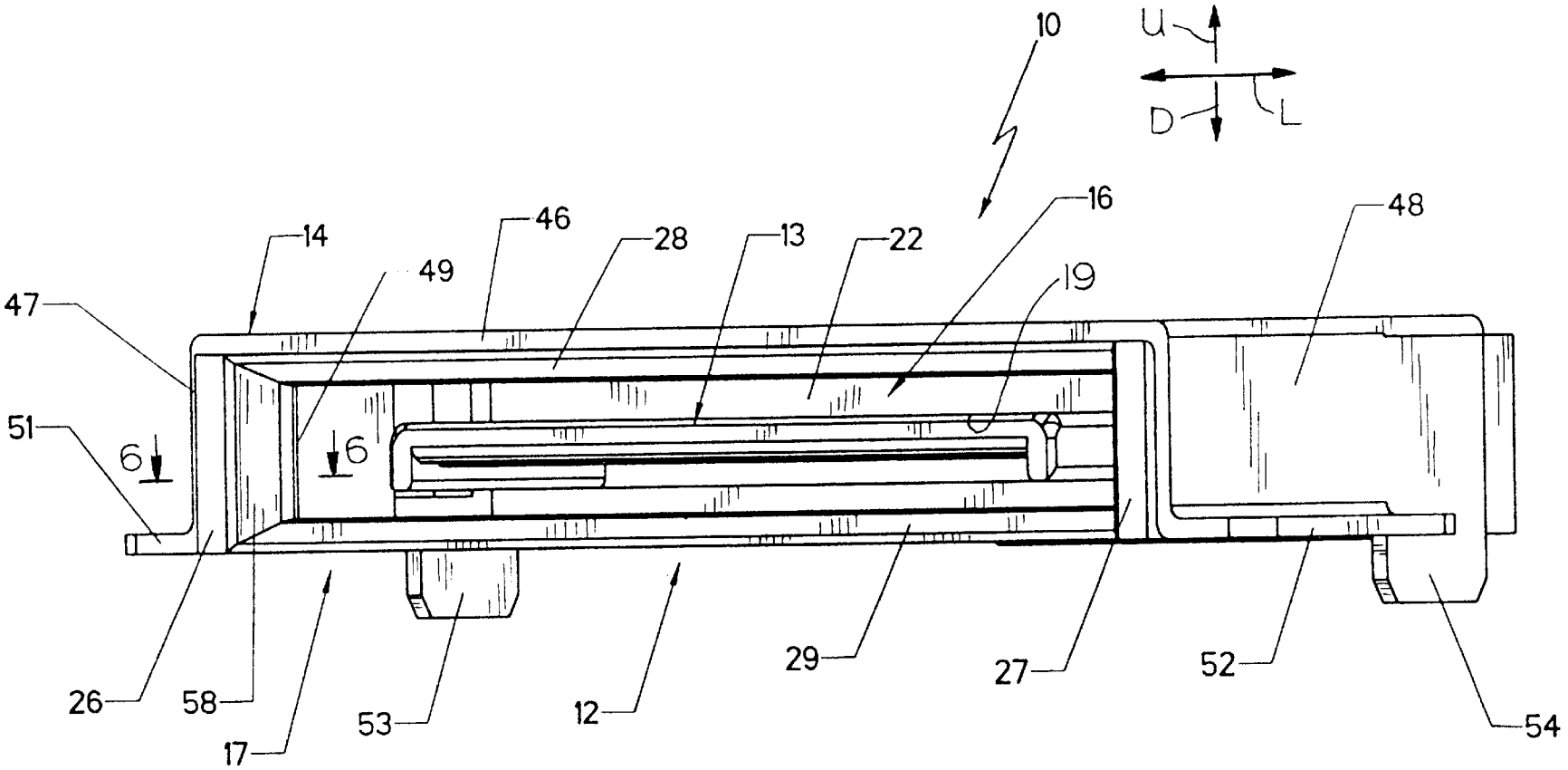
FIG. 4 is a front isometric view of the plug-receiving connector of FIGS. 1–3.

FIG. 1 illustrates a plug-receiving connector 10 of the present invention, which includes a molded plastic housing 12, a contact unit 20, and a sheet metal bracket 14. The plastic housing 12 has walls forming a plug-receiving cavity 16 which is open in a forward direction F. The contact unit 20 has a contact arrangement 13 that comprises at least one row of contacts 37 mounted in a holder 36 of the unit. The unit 20 is installed by moving it in a forward direction F into the cavity 16, so mating ends 38 of the contacts lie within the cavity. As shown in FIG. 3, the plastic housing 12 with the unit 20 therein, is laid on a circuit board 15, with a row of contact tails 39 engaging a row of conductive traces 70 on the circuit board. The plastic housing 12 is reliably secured to the circuit board by lowering the sheet metal bracket 14 onto the plastic housing and attaching the sheet metal bracket directly to the circuit board. Such attachment is achieved by soldering mount tabs 52 of the bracket to solder pads 72 on the circuit board.

Referring again to FIG. 1, it can be seen that the plastic housing has plastic top and bottom walls 28, 29 that are vertically spaced (in up and down directions U, D) and has vertically extending plastic side walls 26, 27 that are laterally spaced (in direction L). The front 17 of the housing is open, while the rear 18 of the housing has a rear wall 21 with a slot 19 that receives the contact unit 20.

The sheet metal bracket 14 has a top plate part 46 that lies in a horizontal plane and substantially facewise against the plastic top wall 28. The bracket includes sheet metal bracket sides 47, 48 extending in vertical planes (that are normal to the lateral direction L) and depending from laterally opposite sides of the top plate part. A forward portion of each sheet metal side holds a corresponding horizontal mount tab 51, 52. The rear portion of each sheet metal side merges with a fixing tab 53, 54 that projects into a cutout in the circuit board to help fix the sheet metal bracket, and therefore also the plastic housing, to the circuit board.

The sheet metal bracket 14 includes a pair of holding tabs 58, 59 that extend downwardly from laterally opposite side portions or sides of the top plate part and that lie in planes parallel to the sheet metal sides. Each holding tab 58, 59 is formed from a cutout or notch 74 in the top plate part When the sheet metal bracket 14 is lowered onto the molded plastic housing 12, each of the holding tabs first passes through a slit 31, 32 formed in the plastic housing top wall 28. Each holding tab passes through the plug-receiving cavity 16, and into a corresponding slit 33, 34 in the plastic bottom wall 29 of the housing. The length of each holding tab 58, 59 in a longitudinal direction M that is parallel to the forward and rearward directions F, R is about equal to the longitudinal lengths of the slits 31–34. As a result, the tabs prevent the plastic housing from moving rearward or forward during mating and unmating with the plug. The holding tabs 58, 59 and the sheet metal sides 47, 48 each lie close to a corresponding one of the plastic side walls 26, 27, and therefore prevent sideward, or lateral L movement of the plastic housing. The top plate part 46 lies closely above the plastic housing top wall 28, to prevent upward movement of the plastic housing, while the circuit board prevents downward movement of the plastic housing. Thus, the sheet metal bracket and circuit board prevent movement of the plastic housing.

Figure 5:
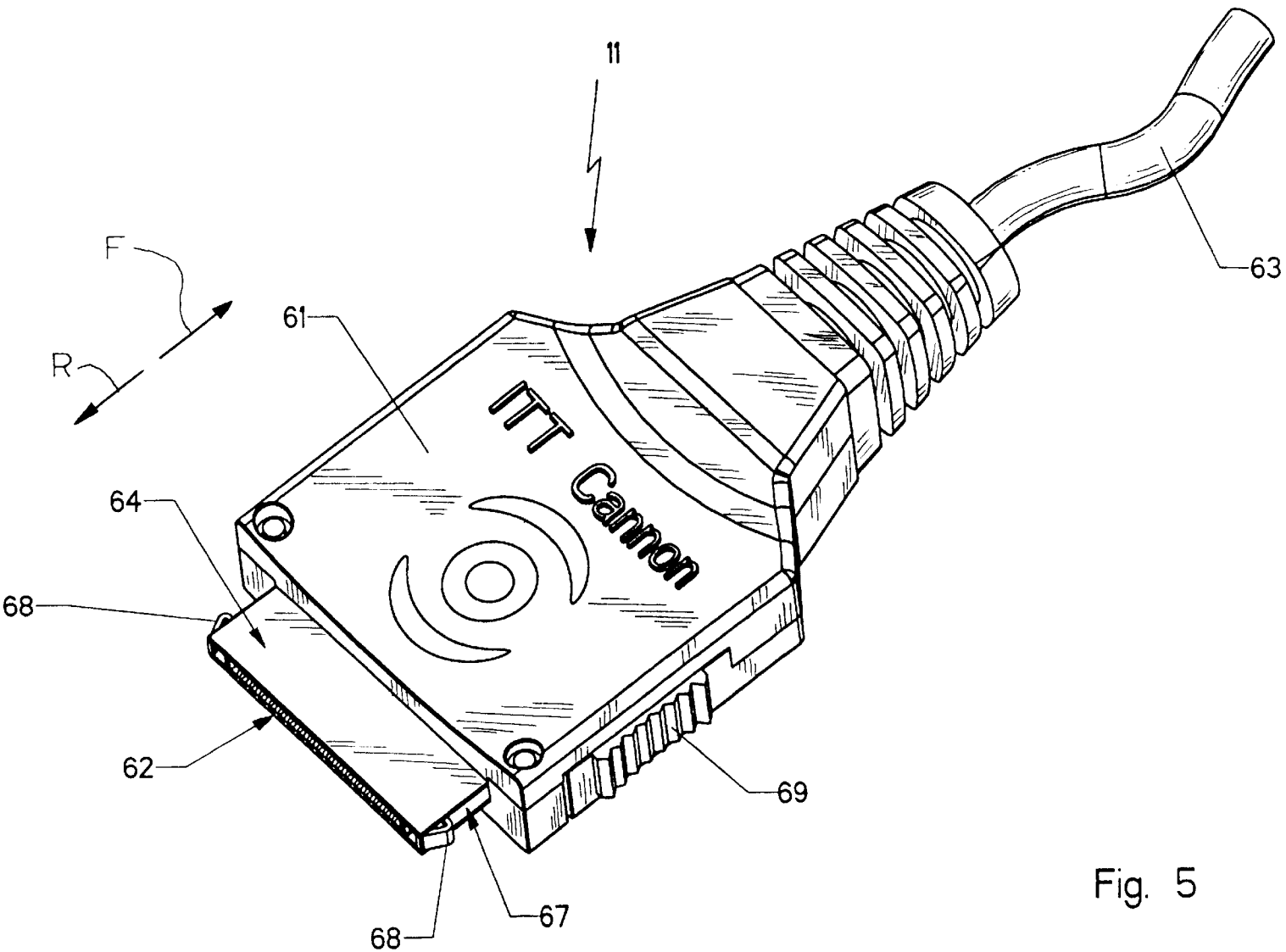
FIG. 5 is an isometric view of a plug constructed to mate with the plug-receiving connector of FIGS. 1–4.

FIG. 5 illustrates the plug 11 which includes a plug housing 61 with a plug component 64 thereon which includes a plug contact assembly 62. The plug component 64 also holds a pair of fingers 67 with latches 68 thereon, which can be moved together or apart by operation of handles 69, the handles being operated by a person's fingers. A cable 63 extends from the plug.

When the plug is moved in the rearward direction R so contacts of its contact arrangement 62 mate with contacts of the plug-receiving connector, the latches 68 latch to the connector to prevent disengagement until the handles 69 are operated (as by squeezing the opposite handles towards each other).

Figure 6:
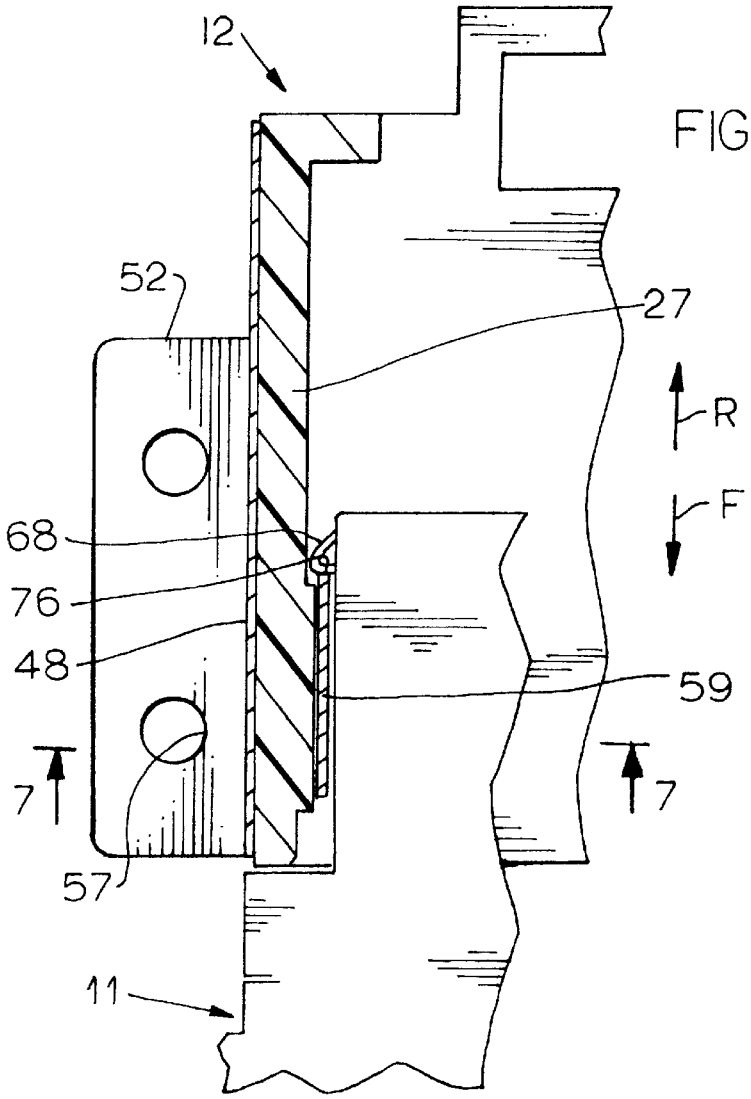
FIG. 6 is a view taken on line 6—6 of FIG. 4.

FIG. 6 shows a latch 68 which has moved behind the rear edge 76 of a sheet metal holding tab 59 of the sheet metal bracket. When forward F forces are applied to the mated plug 11, as when the cord extending from it is pulled, such forces are concentrated on the rear of the sheet metal holding tab 59, with most or all of the force applied directly through the sheet metal bracket to the circuit board and not by way of the plastic housing. As a result, wear and stresses on the molded plastic housing are reduced, because they are instead taken by the sheet metal bracket which acts as a latch strike. The sheet metal bracket can be formed of plated steel, which has a Young's Modulus of Elasticity ($30\times10^6$ that is about two orders of magnitude greater than that of common engineering plastics (whose Young's Modulus is typically about $0.3\times10^6$. Since stresses and wear are concentrated on the metal, the thickness of the molded plastic housing 12 can be reduced to reduce the space occupied by the housing, while still maintaining high strength and wear resistance. It is noted that FIG. 6 shows the plastic housing side wall 27 closely sandwiched between the holding tab 59 and the corresponding sheet metal side 48, which further helps to fix the position of the housing.

Figure 7:
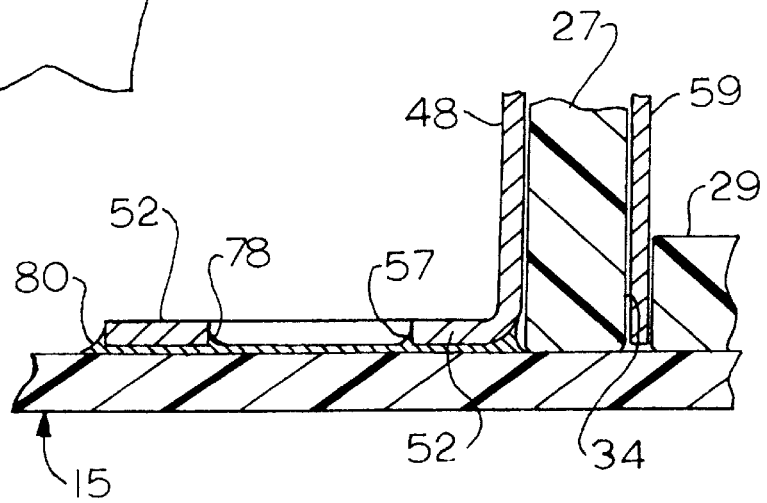
FIG. 7 is a view taken on line 7—7 of FIG. 6.

Each of the mount tabs such as 52 has at least one hole 57. As shown in FIG. 7, the walls of the hole 57 provide an additional edge region where solder fillets 78 can be established, in addition to the fillets 80 at the outer edge of the mount tab, to securely hold the mount tab 52 through solder to the circuit board 15.

FIG. 1 shows that the plastic housing includes a guide shoulder 22 at its rear, with a locking recess 23 therein. The holder 36 of the contact unit has a pair of detent projections 41 that snap into the locking recess 23 when the contact unit is installed, to help hold the contact unit in place. FIG. 2 shows that the holder also includes detent bars 42, 43 which rest against the rear of the housing when the unit is fully installed therein. It is noted that the tails 39 (FIG. 2) of the contacts are closely spaced, at a pitch of about 0.5 mm, while the mating ends 38 of the contacts are spaced at a greater pitch such as about 0.8 mm. The contacts have transition regions 40 that are molded into the holder 36, where the spacing of the contacts is changed.

The connector can be installed by inserting the unit 20 (FIG. 1) into the molded plastic housing 12, and then lowering the sheet metal bracket 14 onto the housing. The combination is placed on a circuit board with the contact tails lying on the traces 70 (FIG. 3) and the mount tabs 51, 52 lying on the solder pads 72. At that time, the bottom of the plastic housing lies on the circuit board. Also, fixing tabs 53 (FIG. 1) that extend from the rear portion of each sheet metal side 47, 48, each extend into a cutout 55 (FIG. 3) in the circuit board. The contact tails 39 and mount tabs 52 are soldered in place as by wave soldering.

While terms such as "top", "bottom", "vertical", "horizontal" have been used to aid in describing the invention, it should be understood that the connector can be used in any orientation with respect to the Earth.

Thus, the invention provides a plug-receiving connector and the combination of that connector with a circuit board, which includes a plastic molded housing for closely receiving a plug and which has a sheet metal bracket that strengthens the connector, holds it more securely to the circuit board, and provides metal at locations of high stress and wear. The sheet metal bracket includes a top plate part that lies closely on top of the plastic housing and has sheet metal sides that depend from laterally opposite sides of the sheet metal plate and that lie closely beyond opposite plastic side walls of the housing. The sheet metal sides are fastened to the circuit board, as by soldering horizontal mount tabs to the circuit board. The sheet metal bracket includes holding tabs that project down through slits in the plastic housing top and bottom walls and into the cavity. The slits help fix the position of the plastic housing and also can engage a latch on a mating plug to resist wear and to take high forces that tend to unmate the plug.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A plug-receiving connector for mounting on a circuit board that has a row of conductive traces, comprising:

a molded plastic housing that is constructed to be mounted on said circuit board, said housing having plastic housing walls forming a forwardly-opening plug-receiving cavity that includes laterally-spaced primarily vertical plastic housing side walls;

a contact arrangement that includes a row of contacts that have mating ends lying in said cavity and that have tails projecting from said housing to engage said traces on said circuit board;

a sheet metal bracket having a top plate part that lies over said housing, and having a pair of sheet metal holding tabs that extend downwardly from said top plate part into said cavity and that lie at laterally opposite sides of said cavity and between said plastic housing vertical side walls:

said housing has top and bottom plastic housing walls each lying primarily in a horizontal plane at the top and bottom of said cavity and forming two pairs of aligned slits, with each slits lying adjacent to one of said plastic housing vertical side walls and with each slit opening into said cavity;

each of said sheet metal holding tabs projects through one of said slits of said top wall and into an aligned slit in said bottom wall;

each of said holding tabs has a predetermined length in a forward-rearward direction, and each of said slits has about the same length as a corresponding holding tab, so the holding tabs limit forward-rearward movement of said plastic housing.

2. The connector described in claim 1 wherein:

said sheet metal bracket has sheet metal sides that extend downwardly from said laterally opposite sides of said top plate part and that lie laterally outside and facewise adjacent to said plastic housing side walls, and each of said plastic housing side walls is sandwiched between one of said sheet metal sides and one of said sheet metal holding tabs.

3. The connector described in claim 2 wherein:

each of said sheet metal sides has a lower end and has a mount tab extending horizontally from the lower end of the side wall for fastening to said circuit board.

4. The connector described in claim 3 wherein:

each of said mount tabs is constructed of solderable material and has at least one hole to increase the total solder fillet length.

5. Plug-receiving apparatus, comprising:

a plastic molded connector housing having plastic housing walls forming a forwardly-opening cavity with opposite sides, said plastic housing walls including vertical side walls each lying in a primarily vertical plane and said plastic housing walls include top and bottom walls each lying in a primarily horizontal plane;

a contact arrangement that includes a row of contacts that have mating ends lying in said cavity and that have tails; wherein said top and bottom walls of said housing have a pair of aligned slits at each of said sides of said cavity; and including a sheet metal bracket mounted on said housing, said bracket having a pair of sheet metal holding tabs that each projects through one of said slits of a pair and at least into the other slit of the pair with each of said slits having substantially the same length as the part of a tab lying therein to prevent relative movement of bracket and said housing along said slits.

6. The apparatus described in claim 5 including:

a circuit board that has a row of conductive traces, with said contact tails soldered to said traces, and that has a pair of solder mount pads;

said sheet metal bracket has a portion that is integral with said holding tabs and that is fixed to said circuit board, said portion including a pair of horizontal mount tabs that are each soldered to one of said solder mount tabs.

7. The apparatus described in claim 6 wherein:

each of said mount tabs has at least one hole, with solder lying in said hole.

8. A method for use with a plastic molded connector housing lying on a circuit board, where the housing has top, bottom, and side walls that form a cavity with a forwardly-opening end, to mount the housing on the circuit board, comprising:

forming said top and bottom walls with a pair of aligned slits where the slits open into said cavity at locations adjacent to said side walls and where each slit is elongated in a forward-rearward direction;

mounting a sheet metal bracket on said housing and on said board to hold said housing to said board, where said bracket has a top plate part with opposite sides and has a pair of downwardly extending sheet metal parts at each of said sides with one metal part being a holding tab and the other being a sheet metal side, where said holding tabs lie between said sheet metal sides and where each sheet metal side is spaced from a corresponding tab by slightly more than the thickness of one of said side walls;

said step of mounting also including projecting said holding tabs down through a slit in said housing wall, through said cavity and at least into a slit in said housing bottom wall, while moving said sheet metal sides outside and beside said housing side walls, and attaching said sheet metal sides to said circuit board;

said step of forming said slits and holding tabs includes forming them so they have the same lengths in forward-rearward direction, so the holding tabs can prevent movement off the plastic housing in forward and rearward directions.

9. A plug-receiving connector for mounting on a circuit board that has a row of conductive traces, where said connector is constructed for mating to a plug that has a latch, comprising:

a molded plastic housing that is constructed to be mounted on said circuit board, said housing having plastic housing walls forming a forwardly-opening plug-receiving cavity that includes laterally-spaced primarily vertical plastic housing side walls;

a contact arrangement that includes a row of contacts that have mating ends lying in said cavity and that have tails projecting from said housing to engage said traces on said circuit board;

a sheet metal bracket having a top plate part that lies over said housing, and having a pair of sheet metal holding tabs that extend downwardly from said top plate part into said cavity and that lie at laterally opposite sides of said cavity and between said plastic housing vertical side walls, with each tab having a primarily rearwardly-facing edge (76) lying in said plug-receiving cavity for providing a shoulder which can be engaged by a plug latch (68) of the plug.

10. The connector described in claim 9 wherein:

said housing has top and bottom plastic housing walls each lying primarily in a horizontal plane and forming two pairs of aligned slits, with each of said slits lying adjacent to one of said plastic housing vertical side walls and with each slit opening into said cavity;

each of said sheet metal holding tabs projects through one of said slits of said top wall and into an aligned slit in said bottom wall.

11. The connector described in claim 9 including said plug, and wherein said plug lies in said cavity and said plug latch is of metal and lies against said shoulder to resist pull-out of said plug from said cavity.

* * * * *